US006925688B1

(12) United States Patent
Savicki

(10) Patent No.: US 6,925,688 B1
(45) Date of Patent: Aug. 9, 2005

(54) CLOSURE DEVICE

(75) Inventor: Alan F. Savicki, Oswego, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 10/049,536

(22) PCT Filed: Jun. 6, 2000

(86) PCT No.: PCT/US00/15566

§ 371 (c)(1),
(2), (4) Date: Feb. 5, 2002

(87) PCT Pub. No.: WO01/94226

PCT Pub. Date: Dec. 13, 2001

(51) Int. Cl.[7] ..... B65D 33/24

(52) U.S. Cl. ..... 24/30.5 R; 24/400; 24/585.12; 24/DIG. 50; 383/64; 493/213

(58) Field of Search ..... 24/30.5 R, 399, 24/585.11, 585.12, 400, DIG. 50, DIG. 39, DIG. 40; 383/64, 69; 493/213

(56) References Cited

U.S. PATENT DOCUMENTS

| | | | | |
|---|---|---|---|---|
| 3,806,998 A | | 4/1974 | Laguerre | |
| 4,186,786 A | | 2/1980 | Kirkpatrick | |
| 4,829,641 A | | 5/1989 | Williams | |
| 5,007,143 A | | 4/1991 | Herrington | |
| 5,140,796 A | | 8/1992 | Pope | |
| 5,248,201 A | | 9/1993 | Kettner et al. | |
| 5,356,222 A | | 10/1994 | Kettner et al. | |
| 5,397,182 A | * | 3/1995 | Gaible et al. | 383/63 |
| 5,647,100 A | * | 7/1997 | Porchia et al. | 24/30.5 R |
| 5,664,299 A | | 9/1997 | Porchia et al. | |
| 6,293,701 B1 | * | 9/2001 | Tomic | 383/64 |

FOREIGN PATENT DOCUMENTS

WO WO 9857863 A1 * 12/1998 ..... B65D/33/25

* cited by examiner

*Primary Examiner*—James R. Brittain
(74) *Attorney, Agent, or Firm*—Thomas C. Feix

(57) ABSTRACT

The closure device includes interlocking fastening strips. The closure device may include a slider slidably disposed on the fastening strips for facilitating the occlusion and deocclusion of the fastening strips. The fastening strips include a first color for facilitating visual confirmation of occlusion of the fastening strips. The visible indication of occlusion will be observed from the top of the closure device. If the fastening strips are properly occluded, then the first color will not be visible by viewing the top of the closure device. The first color will be observed from the top of the closure device when the bag is deoccluded.

30 Claims, 7 Drawing Sheets

CLOSURE DEVICE

FIELD OF THE INVENTION

The present invention relates generally to closure devices and, more particularly, a closure device providing visible confirmation of occlusion. The invention is particularly well suited for use on flexible storage containers, including plastic bags.

BACKGROUND OF THE INVENTION

The use of closure devices for fastening storage containers, including plastic bags, is generally known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the sidewalls of the container are integrally formed by extrusion as a single piece. Alternatively, the closure device and sidewalls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements, which are used to selectively seal the bag. With such closure devices, however, it is often difficult to determine whether the fastening strips are fully occluded.

The invention provides a closure device in combination with visible confirmation of closure. In addition, the invention provides that visible confirmation can be observed from the top of the closure device.

SUMMARY OF THE INVENTION

The closure device includes interlocking fastening strips. The closure device may include a slider slidably disposed on the interlocking fastening strips for facilitating the occlusion and deocclusion of the fastening strips when moved towards first and second ends of the fastening strips.

In addition, the fastening strips have a visual indication of occlusion of the closure device. Thus a user will be able to visually confirm that the closure device has been properly occluded, not only while in the process of occluding the closure device, but also after the closure device has been occluded. The visible indication of occlusion will be observed from the top of the closure device. The closure elements have a first color and the flanges have a second color. If the fastening strips are properly occluded the first color will not be visible by viewing the top of the closure device.

The present invention will become more readily apparent upon reading the following detailed description of exemplified embodiments and upon reference to the accompanying drawings herein.

DESCRIPTION OF THE EMBODIMENTS

Figure 1:
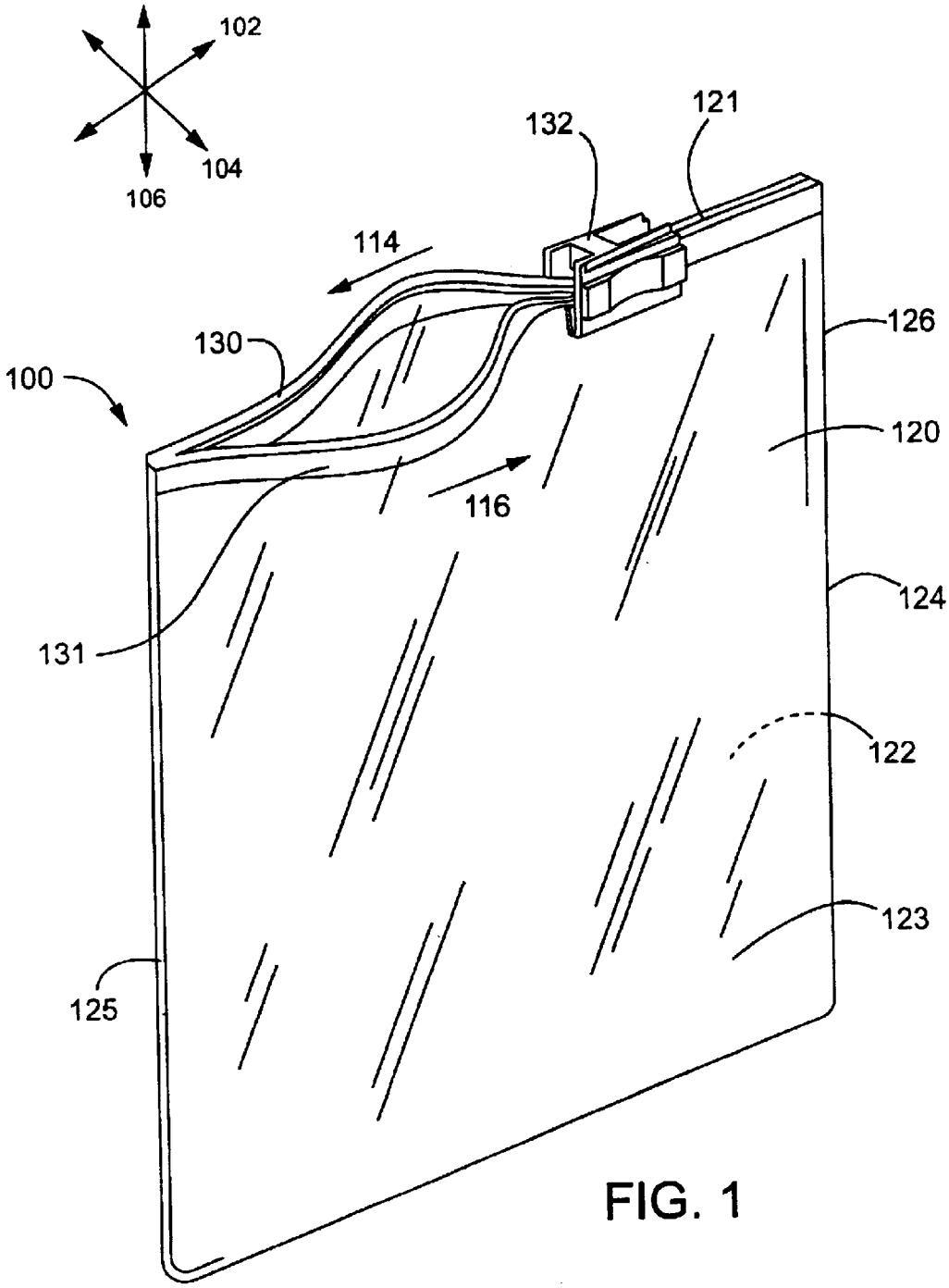
FIG. 1 is a perspective view of a container according to the present invention in the form of a plastic bag.

FIG. 1 illustrates an embodiment of a container in the form of a plastic bag 120 having a sealable closure device 121. The bag 120 includes a first sidewall 122 and a second sidewall 123 joined at seams 124, 125 to define a compartment accessible through the open top end but sealable by means of the closure device 121.

The closure device 121 includes first and second fastening strips 130, 131 and a slider 132. The fastening strips 130, 131 and the slider 132 have a longitudinal X axis 102, a transverse Y axis 104 and a vertical Z axis 106. The transverse Y axis 104 is perpendicular to the longitudinal X axis 102. The vertical Z axis 106 is perpendicular to the longitudinal X axis 102 and the vertical Z axis 106 is perpendicular to the transverse Y axis 104.

The first fastening strip 130 is attached to the first sidewall 122 near the top end of the bag 120. The second fastening strip 131 is attached to the second sidewall 123 near the top end of the bag 120. The fastening strips 130, 131 are located across from and substantially parallel to each other and are configured to allow the fastening strips 130, 131 to be able to interlock. The slider 132 is mounted onto the fastening strips 130, 131 so that the slider 132 is restrained from being removed from the fastening strips 130, 131 but free to slide along the X axis 102. The slider 132 engages the fastening strips 130, 131 so that when the slider 132 moves in an occlusion direction 114, the fastening strips 130, 131 occlude and the bag 120 is sealed, and when the slider 132 moves in a deocclusion direction 116, the fastening strips 130, 131 deocclude or separate and the bag 120 is open.

Figure 2:
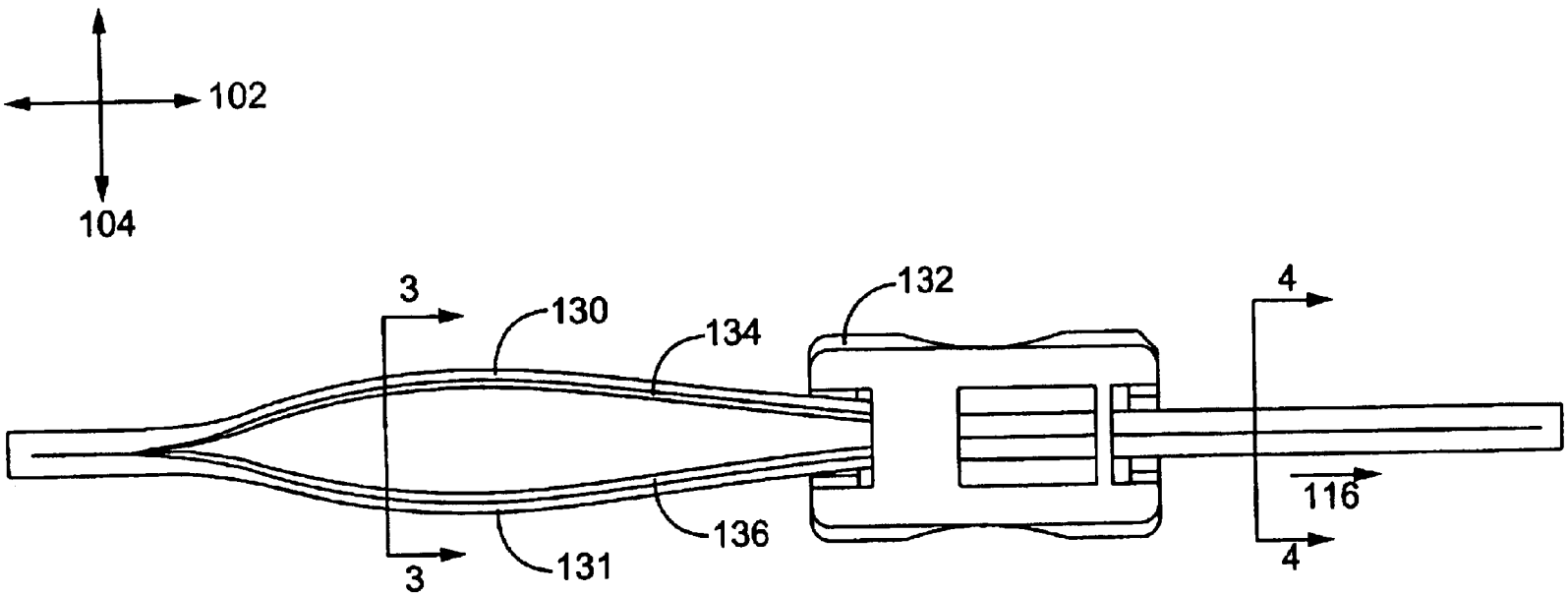
FIG. 2 is a top view of the container in FIG. 1.
Figure 4:
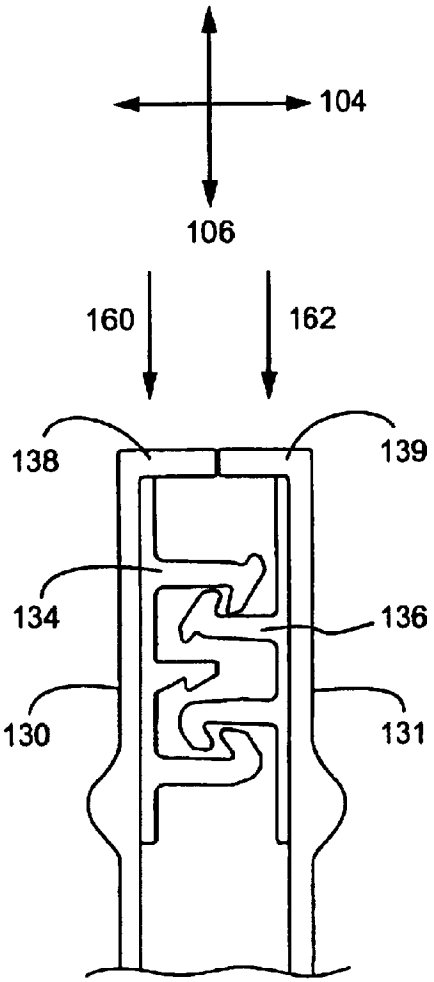
FIG. 4 is a cross-sectional view of the fastening strips along line 4—4 in FIG. 2.
Figure 3:
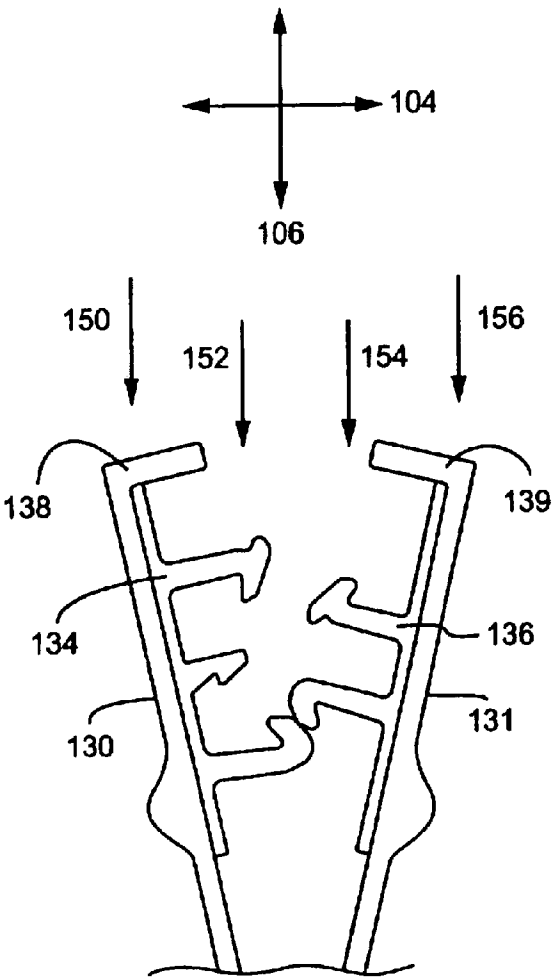
FIG. 3 is a cross-sectional view of the fastening strips along line 3—3 in FIG. 2.

Referring to FIGS. 2–4, the first fastening strip 130 includes a first closure element 134 and the second fastening strip 131 includes a second closure element 136. The first closure element 134 has a first color. The second closure element 136 may have the first color, another color or no color. The first fastening strip 130 may include a flange 138 which extends inwardly toward the second fastening strip 131. The flange 138 may have a second color, another color or no color. The second fastening strip 131 may include a flange 139 which extends inwardly toward the first fastening strip 130. The flange 139 may have a second color, another color of no color.

Figure 6:
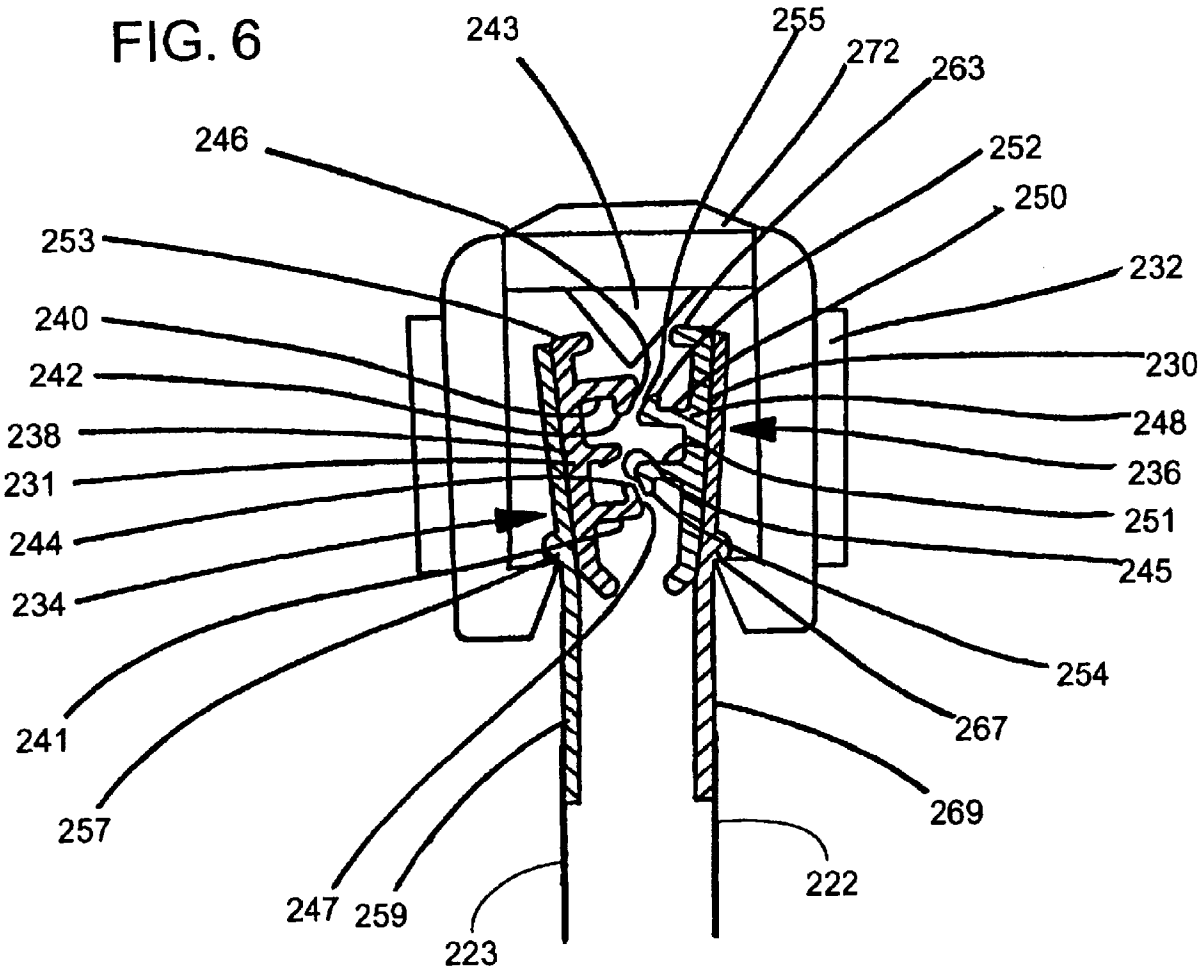
FIG. 6 is a cross-sectional view of fastening strips.

In another embodiment, the flange may be part of the closure element as shown in FIG. 6, but the flange may have a color different than the closure element as noted above.

FIGS. 3 and 4 show the fastening strips in the deoccluded and occluded positions and illustrate the color changes when viewed from the top of the fastening strips in the Z axis 106.

FIG. 3 shows the fastening strips 130, 131 in the deoccluded position. The fastening strips 130, 131 may be viewed from the top of the fastening strips in the Z axis 106 along lines of sight 150, 152, 154, 156. When the fastening strips 130, 131 are viewed along line of sight 150 or line of sight 156, the color of the flanges 138, 139 will be observed. If the fastening strips 130, 131 are viewed from above along line of sight 152 or line of sight 154, the color of the closure elements 134, 136 will be observed.

FIG. 4 shows the fastening strips 130, 131 in the occluded position. Lines of sight 160, 162 illustrate how the fastening strips 130, 131 may be viewed from the top of the fastening strips in the Z axis 106. When the fastening strips 130, 131 are viewed along line of sight 160 or line of sight 162, only the color of the flanges 138, 139 will be observed. In addition, when the fastening strips 130, 131 are fully occluded, the color of the closure elements 134, 136 will not be observed. If the color of the closure elements 134, 136 are observed from above, then this situation is a visual indication that the fastening strips 130, 131 are partially deoccluded as shown in FIG. 5.

Figure 5:
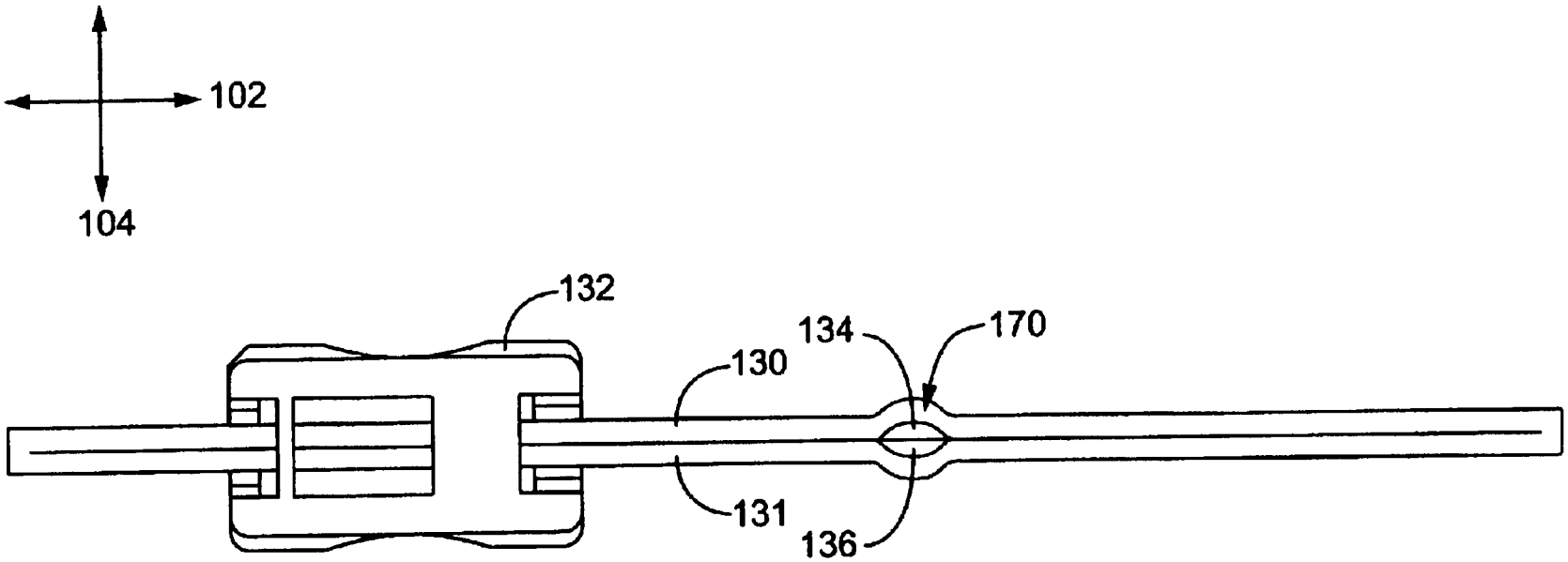
FIG. 5 is a top view of the container in FIG. 1 and illustrates an unoccluded portion in the fastening strips.

FIG. 5 shows a top view of the container and illustrates the slider 132 moved in the occlusion direction. The fastening strips 130, 131 are not fully occluded, and contain a deoccluded portion 170 wherein the fastening strips 130, 131 are partially deoccluded. A partial cross-section of the fastening strips 130, 131 through the deoccluded portion 170 would be similar to FIG. 3. When the deoccluded portion 170 is viewed from above, the color of the closure elements 134, 136 will be observed, indicating that the fastening strips 130, 131 are partially deoccluded. The color of the closure elements 134, 136 and the flanges 138, 139 may be varied in several ways. In a first example, the closure elements 134, 136 may be a first color and the flanges 138, 139 may be a second color.

In a second example, the closure elements 134, 136 may be a first color and the flanges 138, 139 may be a translucent second color. When viewed from the top of the closure device, the second color may visually combine with the first color to create a third color. For example, the first color may be yellow and the second color may be translucent blue and the third color may be green.

In a third example, the closure element 134 may be a first color, the closure element 136 may be a second color and the flanges 138, 139 may be a third color.

In a fourth example, the closure element 134 may be a first color, the closure element 136 may be a second color, the flange 138 may be a third color and the flange 139 may be a fourth color.

In a fifth example, the closure element 134 may have a first color, the closure element 136 may have a second color and the flanges 138, 139 may be clear (i.e., no color). If the fastening strips are occluded and viewed from the top of the fastening strips, the user may see a combined third color which is a combination of the first and second colors, or the user may see that the first and second colors are reduced in color intensity or the first and second colors are eliminated depending upon the clarity of the flanges. As shown in FIG. 6, the fastening strips may be U-channel fastening strips as described in U.S. Pat. No. 4,829,641. U-channel fastening strips include a first fastening strip 230 with a first closure element 236 and a second fastening strip 231 with a second closure element 234. The first closure element 236 engages the second closure element 234. The first fastening strip 230 may include a flange 263 disposed at the upper end of the first fastening strip 230 and a rib 267 disposed at the lower end of the first fastening strip 230. The first fastening strip 230 may include a flange portion 269. Likewise, the second fastening strip 231 may include a flange 253 disposed at the upper end of the second fastening strip 231 and a rib 257 disposed at the lower end of the second fastening strip 231. The second fastening strip 231 may include a flange portion 259. The side walls 222, 223 of the plastic bag 220 may be attached to the fastening strips 230, 231 by conventional manufacturing techniques.

The second closure element 234 includes a base portion 238 having a pair of spaced-apart parallely disposed webs 240, 241, extending from the base portion 238. The base and the webs form a U-channel closure element. The webs 240, include hook closure portions 242, 244 extending from the webs 240, 241 respectively, and facing towards each other. The hook closure portions 242, 244 include guide surfaces 246, 247 which serve to guide the hook closure portions 242, 244 for occluding with the hook closure portions 252, 254 of the first closure element 236.

The first closure element 236 includes a base portion 248 including a pair of spaced-apart, parallely disposed webs 250, 251 extending from the base portion 248. The base and the webs form a U-channel closure element. The webs 250, 251 include hook closure portions 252, 254 extending from the webs 250, 251 respectively and facing away from each other. The hook closure portions 252, 254 include guide surfaces 245, 255, which generally serve to guide the hook closure portions 252, 254 for occlusion with the hook closure portions 242, 244 of the second closure element 234. The guide surfaces 245, 255 may also have a rounded crown surface.

The slider 232 includes a top portion 272. The top portion provides a separator 243 having a first end and a second end wherein the first end may be wider than the second end. In addition, the separator 243 may be triangular in shape. When the slider is moved in the occlusion direction, the separator 243 deoccludes the fastening strips 230, 231 as shown in FIG. 6. Referring to FIG. 6, the closure elements 234, 236 are deoccluded and specifically, the upper hook portions 242, 252 and the lower hook portions 244, 254 are deoccluded.

Figure 7:
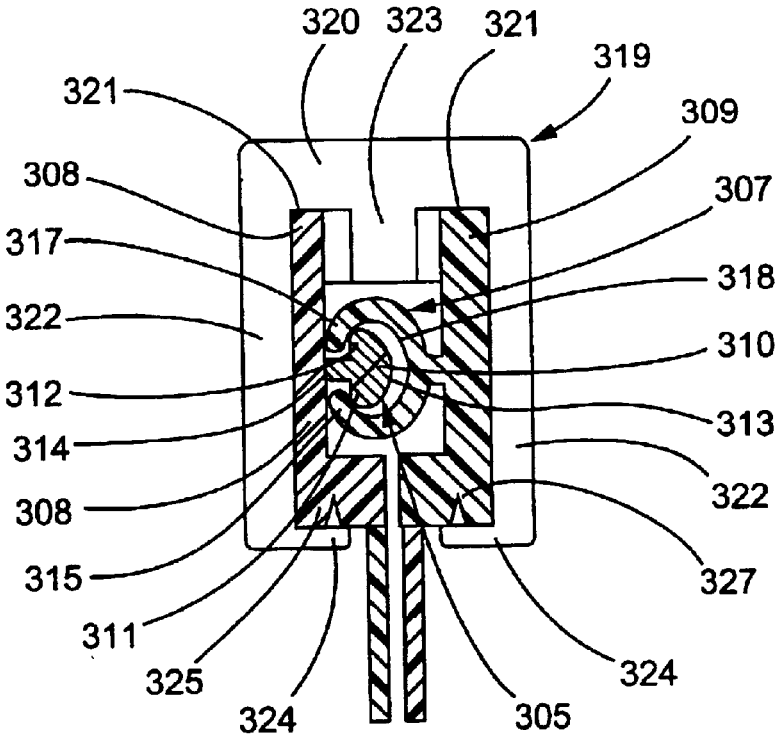
FIG. 7 is a cross-sectional view of another embodiment of fastening strips.

The interlocking fastening strips may comprise "arrowhead-type" or "rib and groove" fastening strips as shown in FIG. 7 and as described in U.S. Pat. No. 3,806,998. The rib element 305 interlocks with the groove element 307. The rib element 305 is of generally arrow-shape in transverse cross section including a head 310 comprising interlock shoulder hook portions 311 and 312 generally convergently related to provide a cam ridge 313 generally aligned with a stem flange 314 by which the head is connected in spaced relation with respect to the supporting flange portion 308. (U.S. Pat. No. 3,806,998, Col. 2, lines 16–23). At their surfaces nearest the connecting stem flange 314, the shoulder portions 311 and 312 define reentrant angles therewith providing interlock hooks engageable with interlock hook flanges 315 and 317 respectively of the groove element 307. (U.S. Pat. No. 3,806,998, Col. 2, lines 23–28). Said hook flanges generally converge toward one another and are spread open to receive the head 310 therebetween when said head is pressed into said groove element 307 until the head is fully received in a groove 318 of said groove element 307 generally complementary to the head and within which the head is interlocked by interengagement of the head shoulder hook portions 311 and 312 and the groove hook flanges 315 and 317. (U.S. Pat. No. 3,806,998, Col. 2, lines 28–36). Through this arrangement, as indicated, the head and groove elements 305 and 307 are adapted to be interlockingly engaged by being pressed together and to be separated when forcably pulled apart, as by means of a generally U-shaped slider 319. (U.S. Pat. No. 3,806,998, Col. 2, lines 36–41).

The slider 319 includes a flat back plate 320 adapted to run along free edges 321 on the upper ends of the sections of the flange portions 308 and 309 as shown in the drawing. (U.S. Pat. No. 3,806,998, Col. 2, lines 41–46). Integrally formed with the back plate 320 and extending in the same direction (downwardly as shown) therefrom are respective coextensive side walls 322 with an intermediate spreader finger 323 extending in the same direction as the side walls at one end of the slider. (U.S. Pat. No. 3,806,998, Col. 2, lines 46–51). The side walls 322 are in the form of panels which are laterally divergent from a narrower end of the slider. (U.S. Pat. No. 3,806,998, Col. 2, lines 51–55). The slider walls 322 are each provided with an inwardly projecting shoulder structure 324 flange adapted to engage respective shoulder ribs 325 and 327 on respectively outer sides of the lower section of the flange portions 308 and 309. (U.S. Pat. No. 3,806,998, Col. 2, line 66 to Co. 3, line 3).

In accordance with the invention, the head 310 may be a first color and the groove element 307 may be a second color or no color. In another embodiment, the head 310 and/or the groove element 307 may be a first color and the fastening. strips may include a flange or flanges as noted above which may be a second color or no color as noted above.

Figure 8:
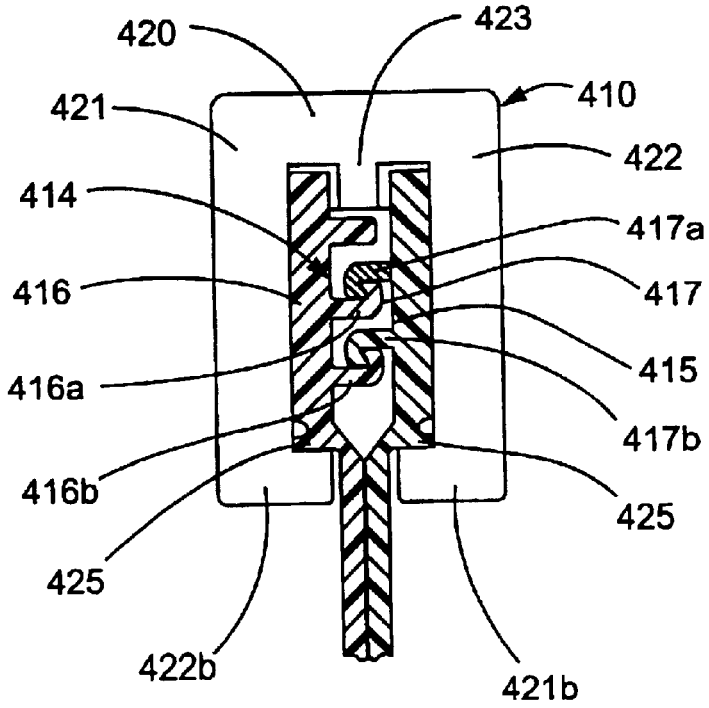
FIG. 8 is a cross-sectional view of another embodiment of fastening strips.

Additionally, the interlocking fastening strips may comprise "profile" fastening strips, as shown in FIG. 8 and described in U.S. Pat. No. 5,664,299. As shown in FIG. 8, the first profile 416 has at least an uppermost closure element 416*a* and a bottommost closure element 416*b*. (U.S. Pat. No. 5,664,299, Col. 3, lines 25–27). The closure elements 416*a* and 416*b* project laterally from the inner surface of strip 414. (U.S. Pat. No. 5,664,299, Col. 3, lines 27–28). Likewise, the second profile 417 has at least an uppermost closure element 417*a* and a bottommost closure element 417*b*. (U.S. Pat. No. 5,664,299, Col. 3, lines 28–30). The closure elements 417*a* and 417*b* project laterally from the inner surface of strip 415. (U.S. Pat. No. 5,664,299, Col. 3, lines 30–32). When the bag is closed, the closure elements of profile 416 interlock with the corresponding closure elements of profile 417. (U.S. Pat. No. 5,664,299, Col. 3, lines 32–34). As shown in FIG. 8, closure elements 416*a*, 416*b*, 417*a* and 417*b* have hooks on the ends of the closure elements, so that the profiles remain interlocked when the bag is closed, thereby forming a seal. (U.S. Pat. No. 5,664,299, Col. 3, lines 34–37).

The straddling slider 410 comprises an inverted U-shaped member having a top 420 for moving along the top edges of the strips 414 and 415. (U.S. Pat. No. 5,664,299, Col. 4, lines 1–3). The slider 410 has side walls 421 and 422 depending from the top 420. (U.S. Pat. No. 5,664,299, Col. 4, lines 3–4). A separating leg 423 depends from the top 420 between the side walls 421 and 422 and is located between the uppermost closure elements 416*a* and 417*a* of profiles 416 and 417. (U.S. Pat. No. 5,664,299, Col. 4, lines 26–30). The fastening assembly includes ridges 425 on the outer surfaces of the fastening strips 414 and 415, and shoulders 421*b* and 422*b* on the side walls of the slider. (U.S. Pat. No. 5,664,299, Col. 4, lines 62–65). The shoulders act as means for maintaining the slider in straddling relation with the fastening strips by grasping the lower surfaces of the ridges 425. (U.S. Pat. No. 5,664,299, Col. 5, lines 4–7).

In accordance with the invention, the uppermost closure element 417*a* may be a first color and the first profile 416 or a portion thereof may be a second color or no color.

Figure 9:
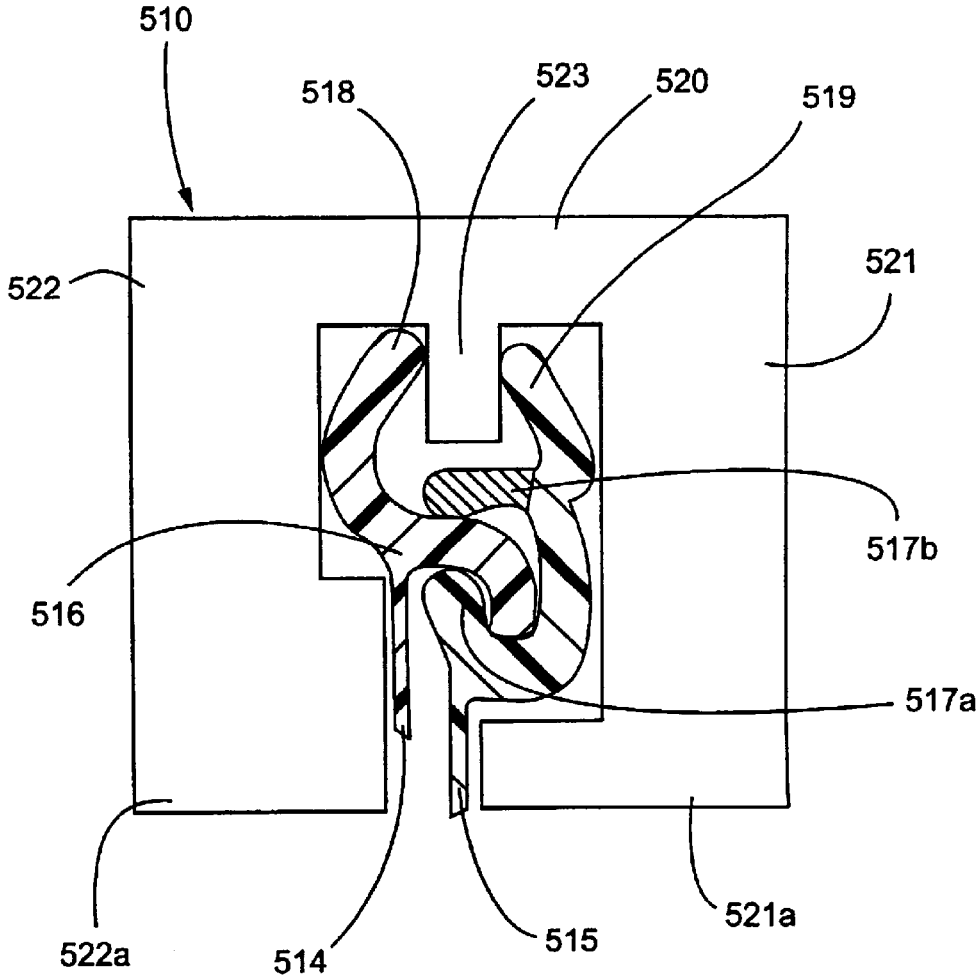
FIG. 9 is a cross-sectional view of another embodiment of fastening strips.

Also, the interlocking fastening strips may be "rolling action" fastening strips as shown in FIG. 9 and described in U.S. Pat. No. 5,007,143. The strips 514 and 515 include profiled tracks 518 and 519 extending along the length thereof parallel to the rib and groove elements 516 and 517 and the rib and groove elements 516, 517 have complimentary cross-sectional shapes such that they are closed by pressing the bottom of the elements together first and then rolling the elements to a closed position toward the top thereof. (U.S. Pat. No. 5,007,143, Col. 4, line 62 to Col. 5, line 1). The rib element 516 is hook shaped and projects from the inner face of strip 514. (U.S. Pat. No. 5,007,143, Col. 5, lines 1–3). The groove element 517 includes a lower hookshaped projection 517*a* and a relatively straight projection 517*b* which extend from the inner face of strip 515. (U.S. Pat. No. 5,007,143, Col. 5, lines 3–6). The profiled tracks 518 and 519 are inclined inwardly toward each other from their respective strips 514 and 515. (U.S. Pat. No. 5,007,143, Col. 5, lines 6–8).

The straddling slider 510 comprises an inverted U-shaped plastic member having a back 520 for moving along the top edges of the tracks 518 and 519 with side walls 521 and 522 depending therefrom for cooperating with the tracks and extending from an opening end of the slider to a closing end. (U.S. Pat. No. 5,007,143, Col. 5, lines 26–31). A separator finger 523 depends from the back 520 between the side walls 521 and 522 and is inserted between the inclined tracks 518 and 519. (U.S. Pat. No. 5,007,143, Col. 5, lines 34–36). The slider 510 has shoulders 521*a* and 522*a* projecting inwardly from the depending side walls 521 and 522 which are shaped throughout the length thereof for cooperation with the depending separator finger 523 in creating the rolling action in opening and closing the reclosable interlocking rib and groove profile elements 516 and 517. (U.S. Pat. No. 5,007, 143, Col. 5, lines 43–49). In accordance with the invention, the projection 517*b* may have a first color and the track 518 or the entire rib element 514 may have a second color or no color.

Although several interlocking fastening strip embodiments have been specifically described and illustrated herein, it will be readily appreciated by those skilled in the art that other kinds, types, or forms of fastening strips may be used without departing from the scope or spirit of the present invention.

The interlocking fastening strips may be manufactured by extrusion through a die.

The interlocking fastening strips may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips. For example, the fastening strips may be made from low density polyethylene.

The fastening strips may be appropriately colored using a suitable colorant such as a dye or pigment.

When the fastening strips are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. For example, the bag may be made from a mixture of high pressure, low density polyethylene and linear, low density polyethylene.

The fastening strips may be manufactured by extrusion or other known methods. For example, the closure device may be manufactured as individual fastening strips for later attachment to the bag or may be manufactured integrally with the bag.

The fastening strips can be manufactured in a variety of forms to suit the intended use. The fastening strips may be integrally formed on the opposing sidewalls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips may be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene).

From the foregoing it will be understood that modifications and variations may be effectuated to the disclosed structures—particularly in light of the foregoing teachings—without departing from the scope or spirit of the present invention. As such, no limitation with respect to the specific.embodiments described and illustrated herein is intended or should be inferred. In addition, all references and copending applications cited herein are hereby incorporated by reference in their entireties.

What is claimed is:

1. A closure device, comprising:

first and second fastening strips, the fastening strips having a longitudinal X axis, a transverse Y axis and a vertical Z axis, the fastening strips are arranged to be occluded over a predetermined length in the X axis, the fastening strips are arranged to be deoccluded and form an opening between the fastening strips when deoccluded, the opening is visible when viewed in the Z axis, the first fastening strip includes a first portion with a first color, the first color is visible when viewed in the Z axis when the fastening strips are deoccluded, the first fastening strip or the second fastening strip includes a second portion with a second translucent color, the first color combines with the second color to form a third color when viewed in the Z axis when the fastening strips are occluded; and wherein the second fastening strip includes a third portion with the first color.

2. The invention as in claim 1 wherein the other fastening strip includes a fourth portion with the second translucent color.

3. The invention as in claim 2 wherein the fourth portion is a flange.

4. The invention as in claim 1 wherein the third portion is a closure element.

5. The invention as in claim 1 wherein the first portion is a closure element.

6. The invention as in claim 1 wherein the second portion is a flange.

7. The invention as in claim 1 wherein the first portion is a closure element, the second portion is a flange.

8. The invention as in claim 7 wherein the closure elements are U-channel closure elements.

9. The invention as in claim 7 wherein the second fastening strip includes a third portion with the first color, the third portion is a closure element, the other fastening strip includes a fourth portion with the second translucent color, the fourth portion is a flange.

10. The invention as in claim 1 wherein the closure device includes a slider slidably disposed on the fastening strips, the slider facilitates occlusion of the fastening strips.

11. A container comprising:

first and second sidewalls joined to form a compartment with an opening;

first and second fastening strips respectively connected to the first and second sidewalls at the opening;

the fastening strips have a longitudinal X axis, a transverse Y axis and a vertical Z axis, the fastening strips are arranged to be occluded over a predetermined length in the X axis, the fastening strips are arranged to be deoccluded and form an opening between the fastening strips when deoccuded the opening is visible when viewed in the Z axis, the first fastening strip includes a first portion with a first color, the first color is visible when viewed in the Z axis when the fastening strips are deoccluded, the first fastening strip or the second fastening strip includes a second portion with a second translucent color, the first color combines with thesecond color to form a third color when viewed in the Z axis when the fastening strips are occluded; and wherein the second fastening stip includes a third portion with the first color.

12. The invention as in claim 11 wherein the other fastening strip includes a fourth portion with the second translucent color.

13. The invention as in claim 12 wherein the fourth portion is a flange.

14. The invention as in claim 11 wherein the third portion is a closure element.

15. The invention as in claim 11 wherein the first portion is a closure clement.

16. The invention as in claim 11 wherein the second portion is a flange.

17. The invention as in claim 11 wherein the first portion is a closure element, the second portion is a flange.

18. The invention as in claim 17 wherein the closure elements are U-channel closure elements.

19. The invention as in claim 17 wherein the second fastening strip includes a third portion with the first color, the third portion is a closure element, the other fastening strip includes a fourth portion with the second translucent color, the fourth portion is a flange.

20. The invention as in claim 11 wherein the closure device includes a slider slidably disposed on the fastening strips, the slider facilitates occlusion of the fastening strips.

21. A method of manufacturing a closure device, comprising:

providing first and second fastening strips, the fastening strips have a longitudinal X axis, a transverse Y axis and a vertical Z axis, the fastening strips are arranged to be occluded over a predetermined length in the X axis, the fastening strips are arranged to be deoccluded and form an opening between the fastening strips when deoccluded, the opening is visible when viewed in the Z axis, providing the first fastening strip includes a first portion with a first color, the first color is visible when viewed in the Z axis when the fastening strips are deoccluded , the first fastening strip or the second fastening strip includes a second portion with a second translucent color, the first color combines with the second color to form a third color when viewed in the Z axis when the fastening strips are occluded; and wherein the second fastening strip includes a third portion with the first color.

22. The invention as in claim 21 wherein the other fastening strip includes a fourth portion with the second translucent color.

23. The invention as in claim 22 wherein the fourth portion is a flange.

24. The invention as in claim 21 wherein the third portion is a closure element.

25. The invention as in claim 21 wherein the first portion is a closure element.

26. The invention as in claim 21 wherein the third portion is a flange.

27. The invention as in claim 21 wherein the first portion is a closure element, the second portion is a flange.

28. The invention as in claim 27 wherein the closure elements are U-channel closure elements.

29. The invention as in claim 21, wherein the second fastening strip includes a third portion with the first color, the third portion is a closure element, the other fastening strip includes a fourth portion with the second trauslucent color, the fourth portion is a flange.

30. The invention as in claim 21 wherein the closure device includes a slider slidably disposed on the fastening strips, the slider facilitates occlusion of the fastening strips.

* * * * *